US009629769B2

(12) United States Patent
Newkirk

(10) Patent No.: US 9,629,769 B2
(45) Date of Patent: Apr. 25, 2017

(54) SUPPORT SYSTEM FOR A LIFT MOTOR UNIT

(71) Applicant: Hill-Rom Services, Inc., Batesville, IN (US)

(72) Inventor: David C. Newkirk, Lawrenceburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 126 days.

(21) Appl. No.: 14/068,674

(22) Filed: Oct. 31, 2013

(65) Prior Publication Data

US 2014/0131301 A1 May 15, 2014

Related U.S. Application Data

(60) Provisional application No. 61/725,168, filed on Nov. 12, 2012.

(51) Int. Cl.
*A61G 7/10* (2006.01)
*B66C 17/00* (2006.01)

(52) U.S. Cl.
CPC ..... *A61G 7/1025* (2013.01); *A61G 7/10* (2013.01); *A61G 7/1034* (2013.01); *A61G 7/1042* (2013.01); *A61G 7/1044* (2013.01); *B66C 17/00* (2013.01)

(58) Field of Classification Search
CPC ..... B66C 19/00; B66C 19/007; B66C 11/06; B66C 17/00; B66C 21/00; B66C 7/00; B66C 5/02
See application file for complete search history.

(56) References Cited

U.S. PATENT DOCUMENTS 3,006,485 A * 10/1961 Crawford ..... 414/542
3,718,263 A * 2/1973 Strecke ..... 212/333
3,721,436 A * 3/1973 Barthel, Jr. ..... 482/69
4,106,641 A * 8/1978 Campbell et al. ..... 414/142.6
4,243,147 A * 1/1981 Twitchell et al. ..... 212/284
(Continued)

OTHER PUBLICATIONS

Safe Lifting Practices for Nurses—Solving the Puzzle of Handling Patients With Care and Responsibility, Reprinted with permission from American Nurse Today, the official journal of the American Nurses Association. Sponsored by Liko, A Hill-Rom Company. p. 6; 156192 rev2 Sep. 17, 2009.
(Continued)

*Primary Examiner* — Emmanuel M Marcelo
*Assistant Examiner* — Michael Gallion
(74) *Attorney, Agent, or Firm* — Barnes & Thornburg LLP

(57) ABSTRACT

One embodiment of a support system for a lift motor unit comprises a first frame comprising left and right first stanchions and a first beam extending laterally between and connected to the stanchions. The support system also includes a similar second frame. A first connector is connected to the first beam and a second connector is connected to the second beam. A rail is connected to the connectors. Another embodiment of the lift motor support system includes similar third and fourth frames and third and fourth connectors. A first rail is connected to the third and fourth connectors, and the rail between the first and second connectors is a second rail. A traverse rail is engaged with and longitudinally translatable along the first and second primary rails.

26 Claims, 12 Drawing Sheets

(56) References Cited

U.S. PATENT DOCUMENTS

| | | | | |
|---|---|---|---|---|
| 4,641,757 | A * | 2/1987 | Rosendale | 212/312 |
| 5,133,465 | A * | 7/1992 | Kalan | 212/285 |
| 5,337,908 | A * | 8/1994 | Beck, Jr. | 212/312 |
| 5,456,655 | A * | 10/1995 | Morris | 601/23 |
| 5,499,408 | A * | 3/1996 | Nix | 5/85.1 |
| 5,511,256 | A * | 4/1996 | Capaldi | 5/83.1 |
| 5,526,614 | A * | 6/1996 | Huang | 52/13 |
| 5,593,050 | A * | 1/1997 | Lange | 212/325 |
| 5,667,461 | A * | 9/1997 | Hall | 482/69 |
| 5,669,518 | A * | 9/1997 | Kundel | 212/315 |
| 5,809,591 | A * | 9/1998 | Capaldi et al. | 5/83.1 |
| 5,810,183 | A * | 9/1998 | Feider et al. | 212/291 |
| 5,872,438 | A * | 2/1999 | Roston | 318/568.11 |
| 5,952,796 | A * | 9/1999 | Colgate et al. | 318/1 |
| 6,637,610 | B1 * | 10/2003 | Cheeseboro | 212/327 |
| 6,739,096 | B2 * | 5/2004 | Feldpausch et al. | 52/36.1 |
| 7,048,491 | B2 * | 5/2006 | Windbergs | 414/542 |
| 7,240,621 | B2 * | 7/2007 | Chepurny et al. | 104/173.1 |
| 7,462,138 | B2 * | 12/2008 | Shetty et al. | 482/69 |
| 7,506,589 | B2 * | 3/2009 | Hjort | 104/126 |
| 7,883,450 | B2 * | 2/2011 | Hidler | 482/69 |
| 7,921,484 | B2 * | 4/2011 | Bendele et al. | 5/83.1 |
| 7,930,775 | B2 * | 4/2011 | Kluckhuhn | 5/85.1 |
| 8,006,440 | B2 | 8/2011 | Thomas et al. | |
| 8,006,956 | B2 * | 8/2011 | Payne | 254/286 |
| 8,286,281 | B1 * | 10/2012 | Toothman | 5/81.1 R |
| 8,678,209 | B2 * | 3/2014 | Chernyak | 212/324 |
| 8,910,374 | B2 * | 12/2014 | Davi et al. | 29/705 |
| 8,960,459 | B2 * | 2/2015 | Givens | 212/73 |
| 2001/0027149 | A1 * | 10/2001 | Bingham | 482/69 |
| 2002/0084238 | A1 * | 7/2002 | Zingerman | 212/179 |
| 2004/0026349 | A1 * | 2/2004 | Colgate et al. | 212/284 |
| 2010/0095604 | A1 | 4/2010 | Newkirk et al. | |
| 2011/0000015 | A1 * | 1/2011 | Faucher et al. | 5/83.1 |
| 2012/0000876 | A1 * | 1/2012 | Bergenstrale et al. | 212/336 |
| 2012/0005980 | A1 * | 1/2012 | Kundel et al. | 52/651.05 |
| 2012/0043865 | A1 | 2/2012 | Newkirk et al. | |
| 2013/0074343 | A1 | 3/2013 | Newkirk et al. | |
| 2013/0134120 | A1 * | 5/2013 | Won et al. | 212/328 |

OTHER PUBLICATIONS

Hill-Rom, The FreeStand Lift System—Liko handout; 167885 rev 1 Mar. 23, 2011.

FreeSpan Ultra Twin System—Liko handout; 156116 rev 1 Jan. 7, 2009.

Safe Lifting Solutions—Liko Brochure—pp. 7-8; 156710 rev 2 Mar. 7, 2011.

Overheal Lifts—Liko Brochure—156409 rev 2 Jan. 20, 2011.

* cited by examiner

SUPPORT SYSTEM FOR A LIFT MOTOR UNIT

TECHNICAL FIELD

The subject matter described herein relates to a support system for a lift motor unit of the type used by caregivers to lift a patient and transport the patient from a source location to a destination location.

BACKGROUND

Lift systems are used in hospitals, other health care facilities, and sometimes in home care settings to move a patient from one location to another or to assist the patient in moving. A typical lift system includes a lift motor unit translatably mounted on a rail that extends along the ceiling of the room. The components of the lift motor unit include a battery and a motor. The motor is operably connected to a strap or tether that extends vertically downwardly from the lift motor unit. The lift system also includes a sling bar attached to the end of the tether remote from the motor. To use the lift system a caregiver secures a patient in a sling, attaches the sling to the sling bar, and uses a control device to operate the motor to lift the patient to a higher elevation or lower the patient to a lower elevation. In one typical example the caregiver operates the motor to raise the patient off a bed, pulls on the sling to cause the motor unit to translate along the rail until the patient is positioned over a desired destination location, and then operates the motor again to lower the patient to the destination.

Hospitals and other health care facilities also employ headwall units and footwall units, which are also referred to simply as headwalls and footwalls. A headwall is a collection of components arrayed along an architectural wall of a facility, in particular along a wall that neighbors the head end of a bed. A typical headwall includes headwall frame components and panels that are attachable to the frame components in such a way that the panels hide the headwall frame components. Some panels are functional in that they include fixtures such as electrical outlets, medical gas outlets, suction ports and lighting controls. Other panels may be purely decorative in order to help create an aesthetically pleasant environment. Headwalls may also include storage units such as cabinets or shelving. Headwalls may also include equipment supports which are typically secured to a frame component by fasteners that penetrate through a panel and connect with a frame element. A footwall is similar to a headwall but is disposed along an architectural wall which is remote from the head end of the bed and spaced from the foot end of the bed to accommodate pedestrians, such as caregivers, custodial staff and patient visitors. The footwall and its panels may also include many of the features and components of headwalls such as electrical outlets, lighting controls, cabinets, shelving, and equipment supports, but do not typically include clinical features such as gas outlets and suction ports. Example headwall and footwall units are further described in United States Patent Application Publication 2010/0095604, the contents of which are incorporated herein by reference.

A facility governing body, such as a board of directors, may elect to renovate or upgrade patient rooms with new headwalls. The governing body may also choose to upgrade the footwalls at the same time. The governing body may also decide to include a lift system. However, the cost of procuring all three elements (headwall, footwall and lift system) can be prohibitive and the need to coordinate the acquisition and installation of the elements causes additional burden for the personnel responsible for capital improvements, particularly when the supplier of the lift system and the supplier of the headwall and footwall are different suppliers. Moreover, to the extent that lift system components such as the rail are secured to overhead structural components of the facility, there may be a need to relocate pre-existing elements of the facility infrastructure such as plumbing lines, electrical wires, sewage lines and HVAC ducts and/or to accommodate those elements by suboptimal positioning of the rail.

SUMMARY

One embodiment of a support system for a lift motor unit comprises a first frame comprising left and right first stanchions and a first beam extending laterally between and connected to each of the left and right first stanchions. The support system also includes a second frame longitudinally spaced from the first frame. The second frame comprises left and right second stanchions and a second beam extending between and connected to each of the left and right second stanchions. The system also includes a first connector connected to the first beam and a second connector connected to the second beam. The system also includes a rail having a head end connected to the first connector and a foot end connected to the second connector. Another embodiment of the lift motor support system further includes a third frame laterally spaced from the first frame. The third frame comprises left and right third stanchions and a third beam extending laterally between and connected to each of the left and right third stanchions. The embodiment also further includes a fourth frame laterally spaced from the second frame and longitudinally spaced from the third frame. The fourth frame comprises left and right fourth stanchions and a fourth beam extending laterally between and connected to each of the left and right fourth stanchions. A third connector is connected to the third beam and a fourth connector is connected to the fourth beam. A first primary rail is connected to the third and fourth connectors. The rail connected to the first and second connectors is a second primary rail. A traverse rail is engaged with and translatable along the first and second primary rails. The first and second primary rails may be left and right primary rails or may be right and left primary rails.

BRIEF DESCRIPTION OF THE DRAWINGS

The foregoing and other features of the various embodiments of the support system for a lift motor unit described herein will become more apparent from the following detailed description and the accompanying drawings in which.

DETAILED DESCRIPTION

Figure 1:
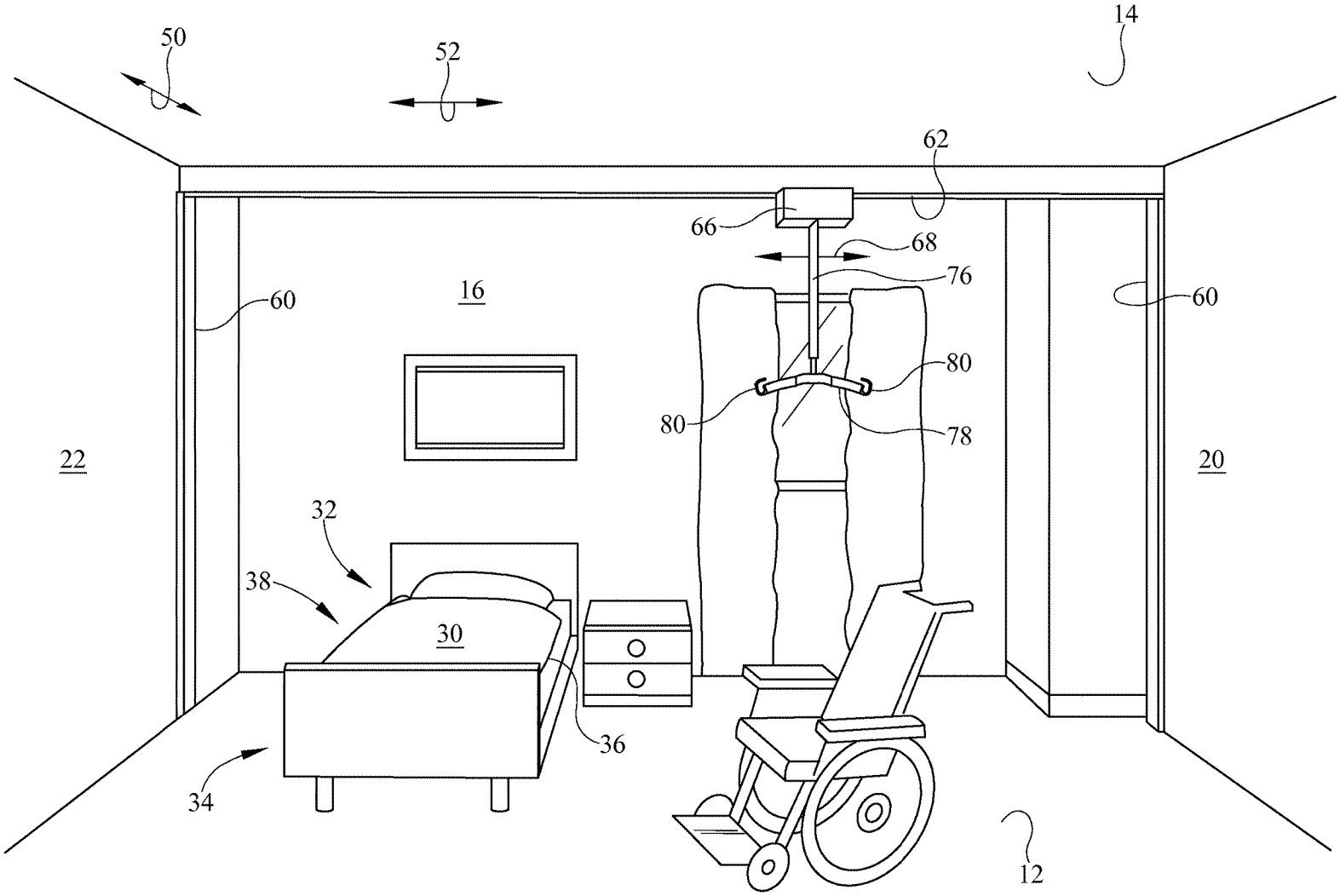
FIG. 1 is a perspective view of a hospital room showing elements of an example facility integrated lift system.
Figure 4:
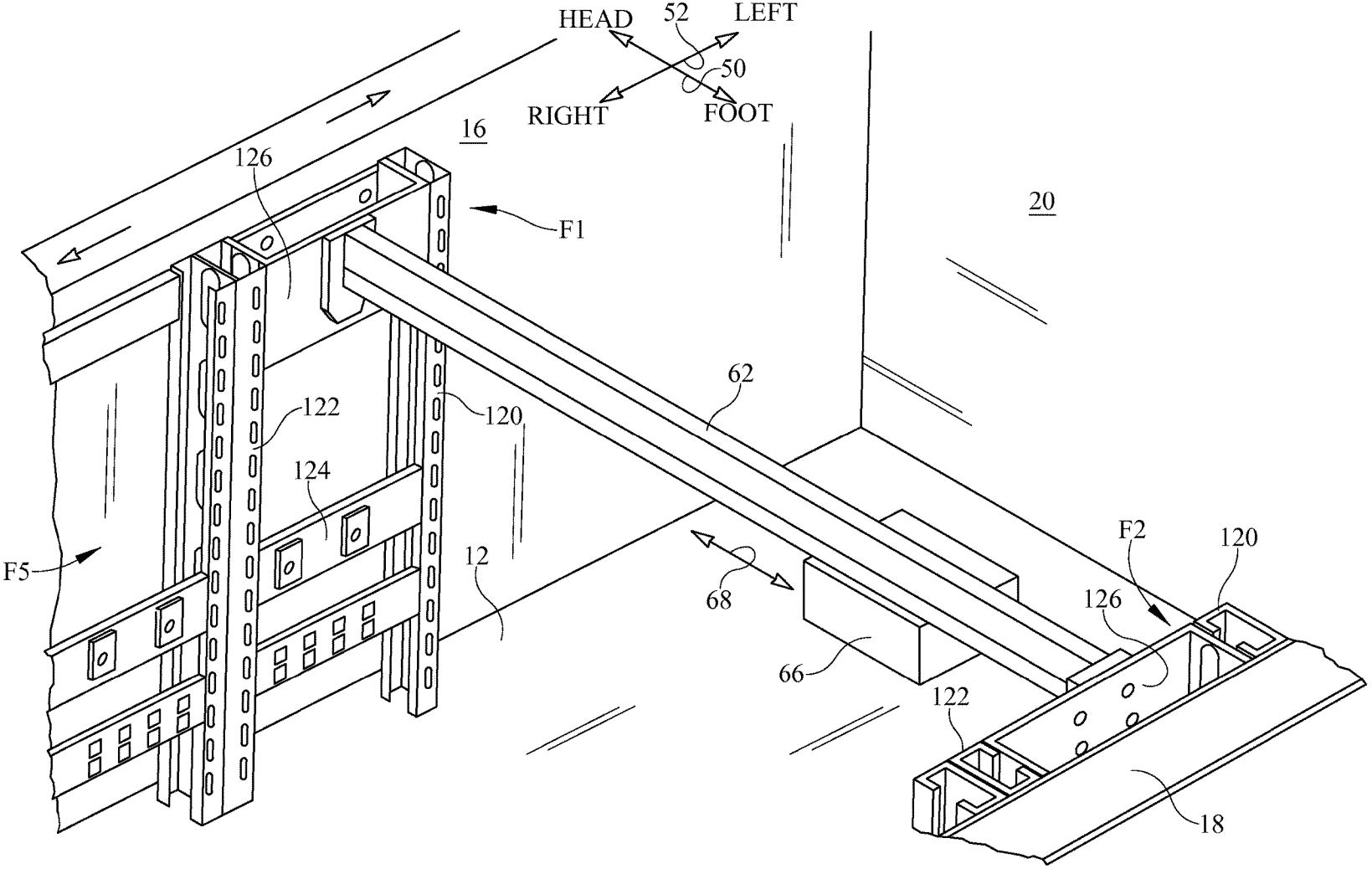
FIG. 4 is a perspective view of a concept sketch of a support system for a lift motor unit of a lift system.
Figure 5:
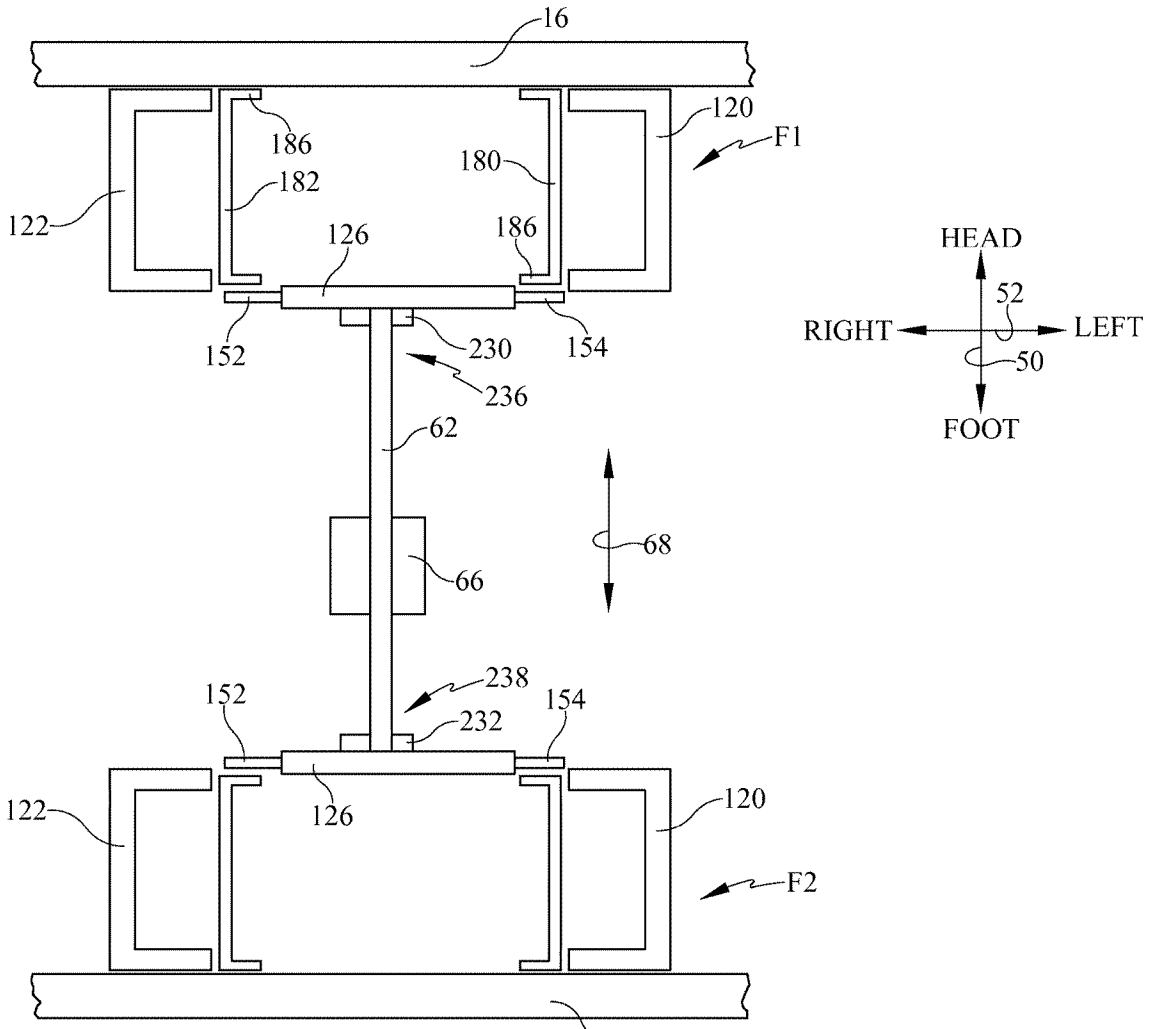
FIG. 5 is a plan view of a hospital room including a support system for a lift motor unit of a lift system.
Figure 6:
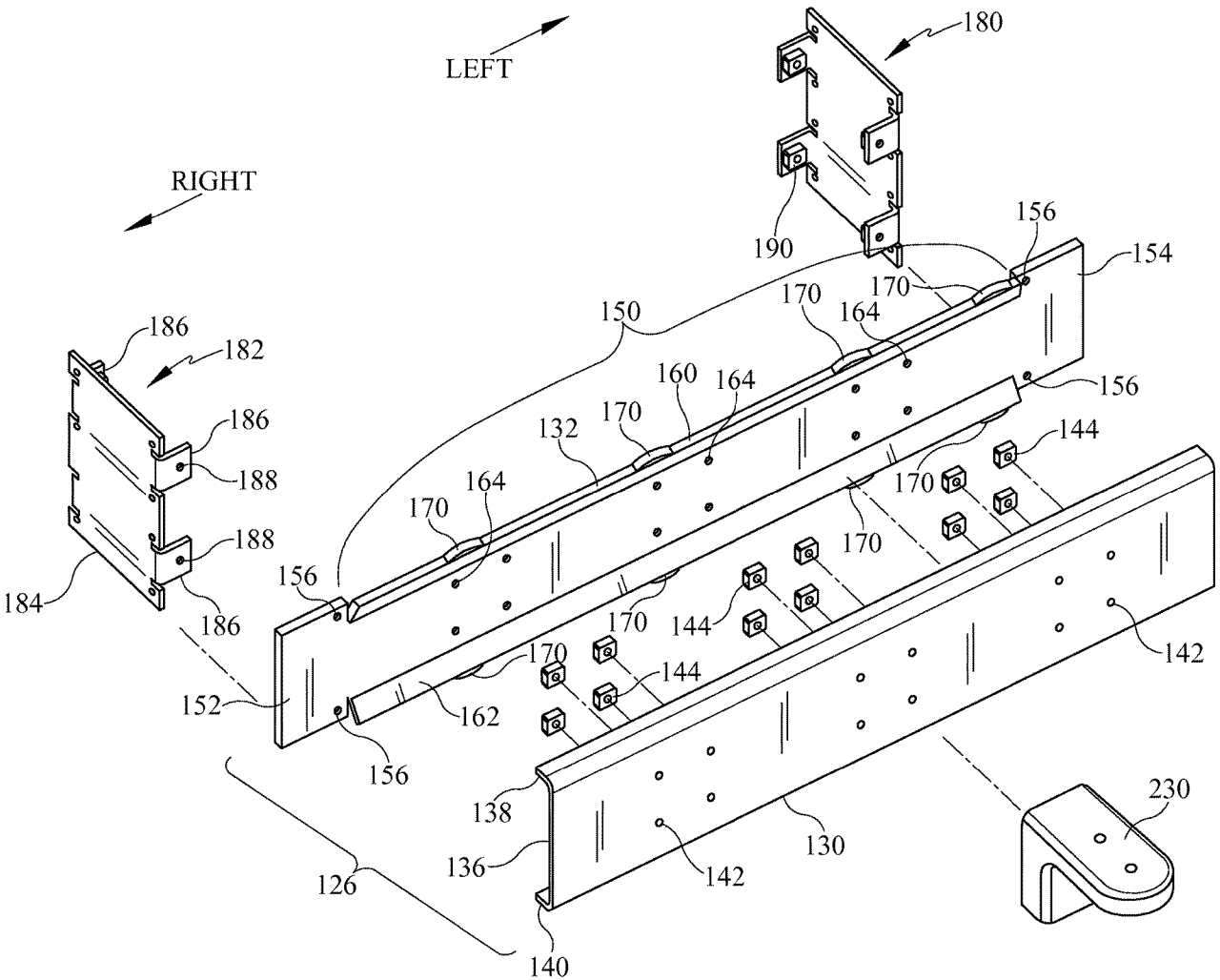
FIGS. 6-8 are perspective views showing components of the support system and in which the components are depicted less conceptually than in FIGS. 4-5.

FIG. 1 shows a hospital room having a floor 12, a ceiling 14, and architectural walls 16, 18, 20, 22 only three of which are visible, the fourth being visible in FIGS. 4-5. A bed 30 extends lengthwise from a head end 32 to a foot end 34 and widthwise from a left side 36 to a right side 38. The terms "left" and "right" are from the perspective of a supine occupant of the bed whose head is near head end 32 and whose feet are near foot end 34. Because wall 16 neighbors the head end of a bed it is referred to as an architectural headwall, walls 20, 22 are left and right architectural sidewalls, and wall 18 (FIGS. 4-5) is an architectural footwall. The illustration also includes directional arrows 50, 52 to indicate longitudinal and lateral room directions. Throughout this specification the longitudinal direction is parallel to the lengthwise dimension of the bed and the lateral dimension is parallel to the widthwise dimension of the bed. However the terms "longitudinal" and "lateral" are used to distinguish between two orthogonal directions of the room and are not to be construed as limited to directions parallel to the lengthwise and widthwise dimensions respectively of the bed.

Figure 2:
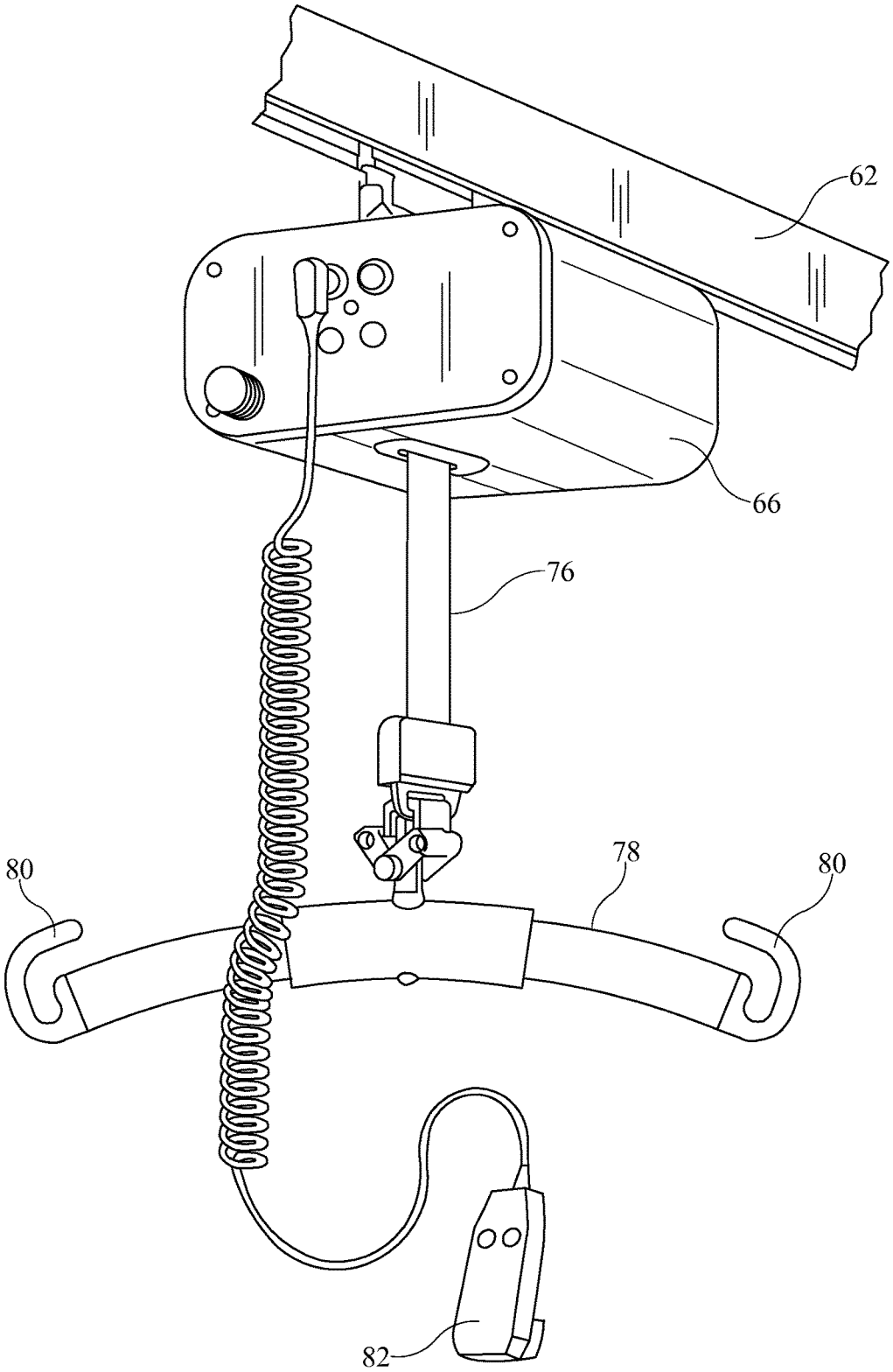
FIG. 2 is a perspective view showing certain elements of the lift system in greater detail.
Figure 10:
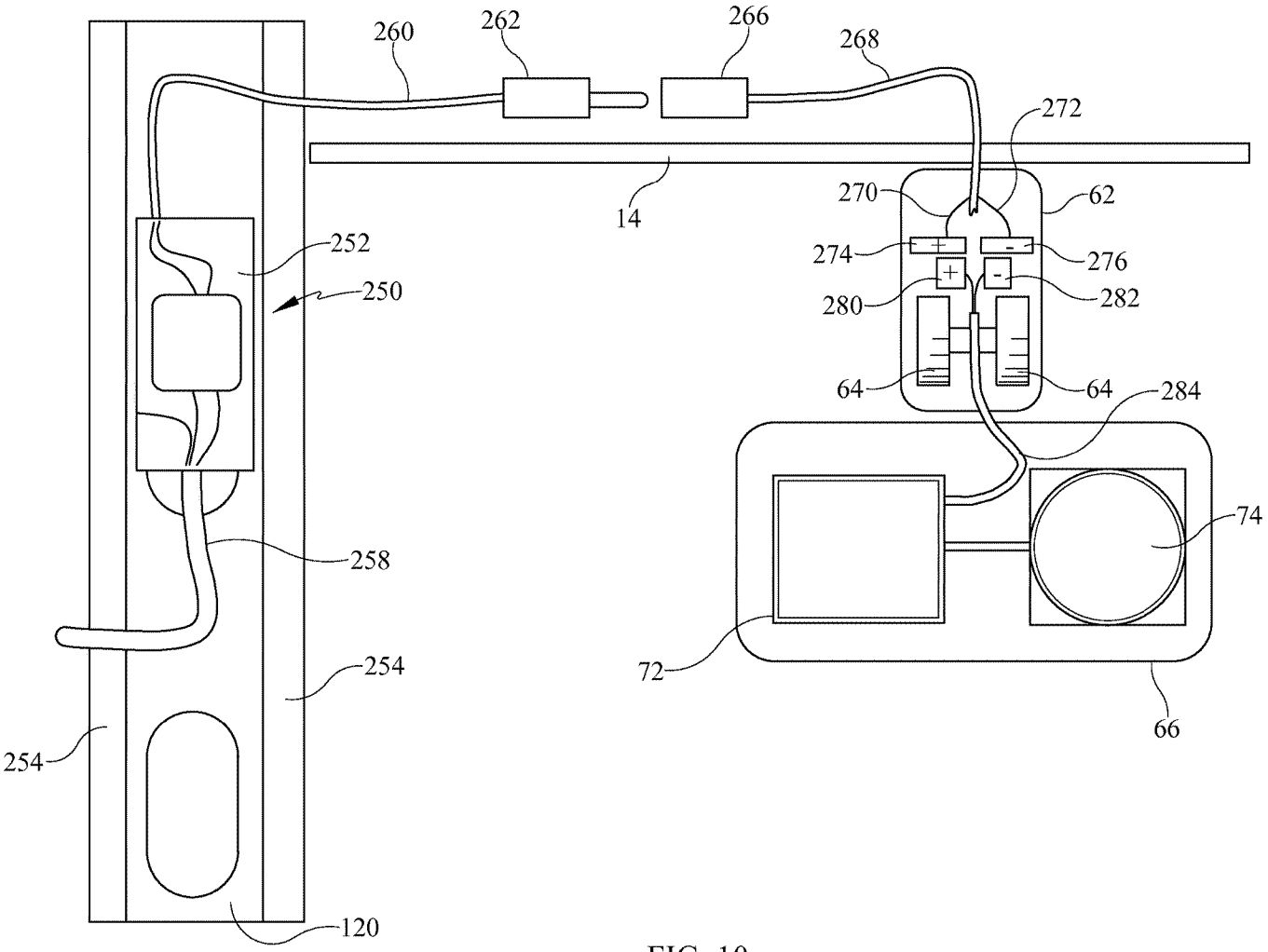
FIG. 10 is a schematic view of a power supply system for a lift motor and an in-rail charging system for a battery associated with the lift motor.

The illustration also shows elements of a facility integrated lift system which include upright supports 60 affixed to the architectural sidewalls, specifically to structural elements of the sidewalls such as wall studs, and a rail 62 extending laterally between upright supports 60. Rail 62 is secured to uprights 60 by, for example, brackets (not visible) and/or is secured to the ceiling, specifically to structural elements of the ceiling such as ceiling joists, by suitable fastening elements, also not shown. A lift motor unit 66 engages the rail and is manually translatable therealong on rollers 64 (FIG. 10) as indicated by arrow 68. Accordingly, rail 62 may be referred to as a lift motor rail. As also seen in FIG. 10, the lift motor unit includes a battery 72 and a direct current (DC) motor 74. Referring additionally to FIG. 2, the motor is operably connected to a strap or tether 76 that extends vertically downwardly from the lift motor unit. A sling bar 78 having hooks 80 is attached to the end of the tether remote from the motor. As already noted in the "Background" section of this application a caregiver or other user uses the lift system by securing a patient in a sling, not shown, attaching the sling to the sling bar hooks, and using a control device 82 to operate the motor.

Figure 3:
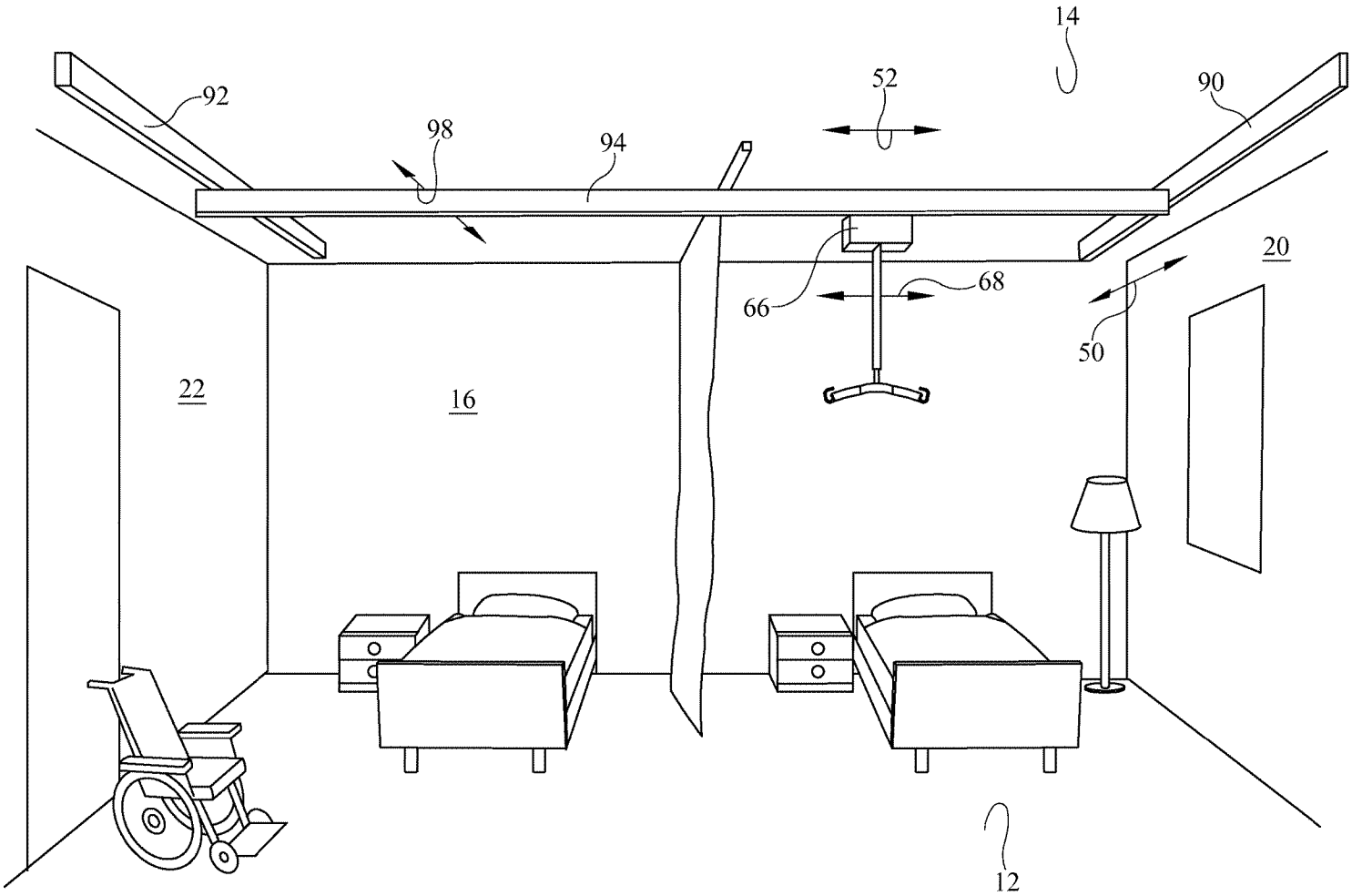
FIG. 3 is a view similar to that of FIG. 1 showing an example of an alternative facility integrated lift system.

FIG. 3 shows a second example of a facility integrated lift system. The lift system includes left and right primary rails 90, 92 secured to ceiling 14, specifically to structural elements of the ceiling such as ceiling joists, by suitable fastening elements. The lift system also includes a traverse rail 94 which engages both of the primary rails and is translatable along the primary rails as indicated by arrow 98, i.e. in the room longitudinal direction. A lift motor unit 66 engages the traverse rail and is translatable therealong as indicated by arrow 68. Accordingly, traverse rail 94, like rail 62 of FIG. 1, may be referred to as a lift motor rail.

Referring to FIGS. 4-8, a support system for a lift motor unit 66 includes a first frame F1 comprising left and right first stanchions 120, 122 and one or more cross members 124 bridging between adjacent stanchions to secure the stanchions together. A first beam 126 comprises a front plate 130 and a back plate 132. Front plate 130 has a face or face portion 136 and upper and lower flanges 138, 140 extending rearwardly from the face at about a 90 degree angle. Three sets of four holes 142 penetrate through face 136. Nuts 144 are welded to a back side of the front face so that the threaded hole in each nut registers with a hole 142. Back plate 132 includes a center section 150 and wings 152, 154. A pair of holes 156 penetrates through each wing. Center section 150 includes upper and lower flanges 160, 162 extending forwardly and nonorthogonally from the center section. Three sets of four holes 164 penetrate through center section 150. The front plate and back plate are connected to each other, for example by spot welds at locations 170, so that holes 142 register with holes 164 and wings 152, 154 project laterally beyond the left and right edges of the front face.

The first frame also includes a pair of left and right brackets 180, 182, which may be identical to each other. Each bracket comprises a plate portion 184 and a set of tabs 186. A hole 188 penetrates through each tab. A nut 190 is welded to an inner face of each tab so that the threaded hole in each nut registers with a hole 188.

Figure 7:
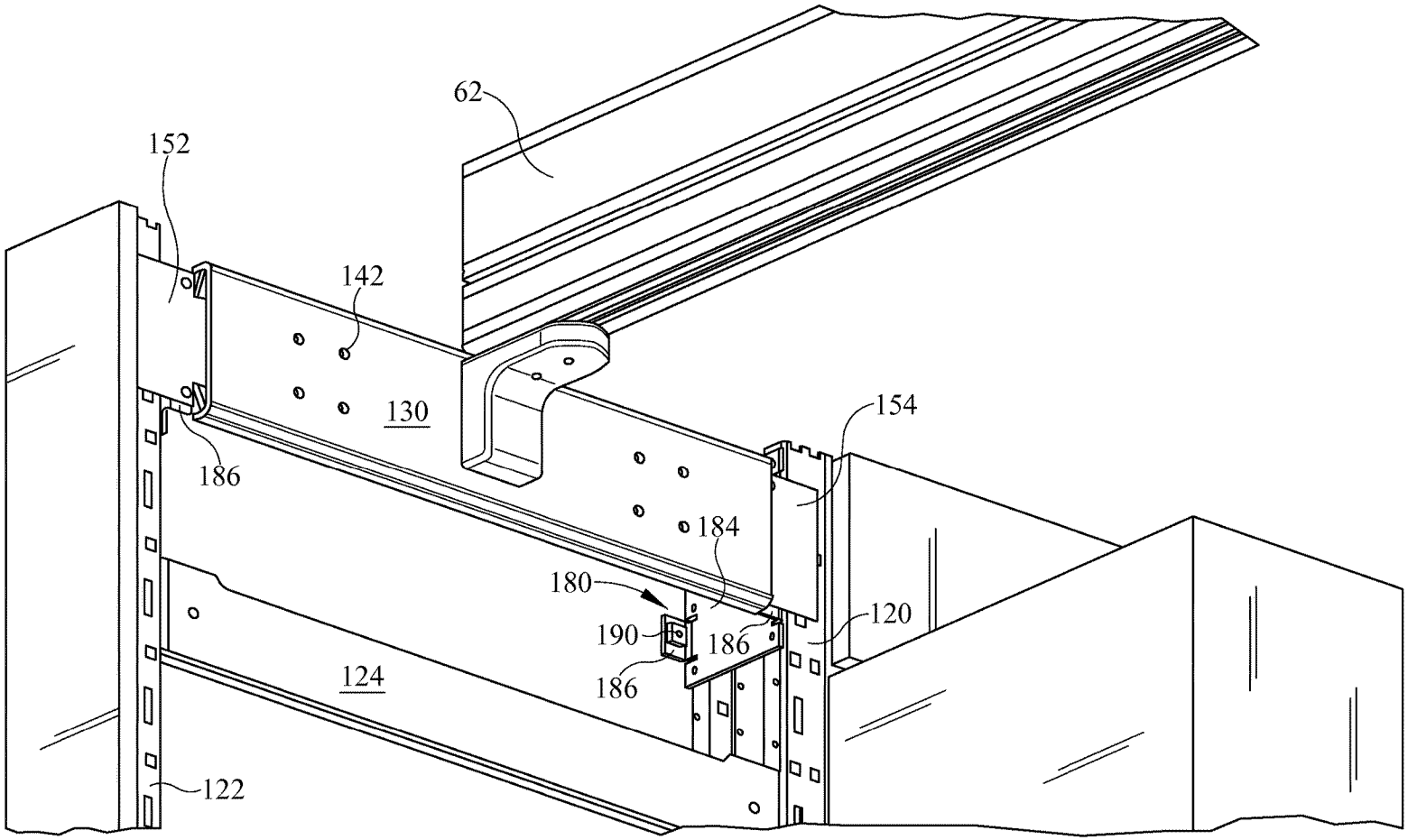
Figure 8:
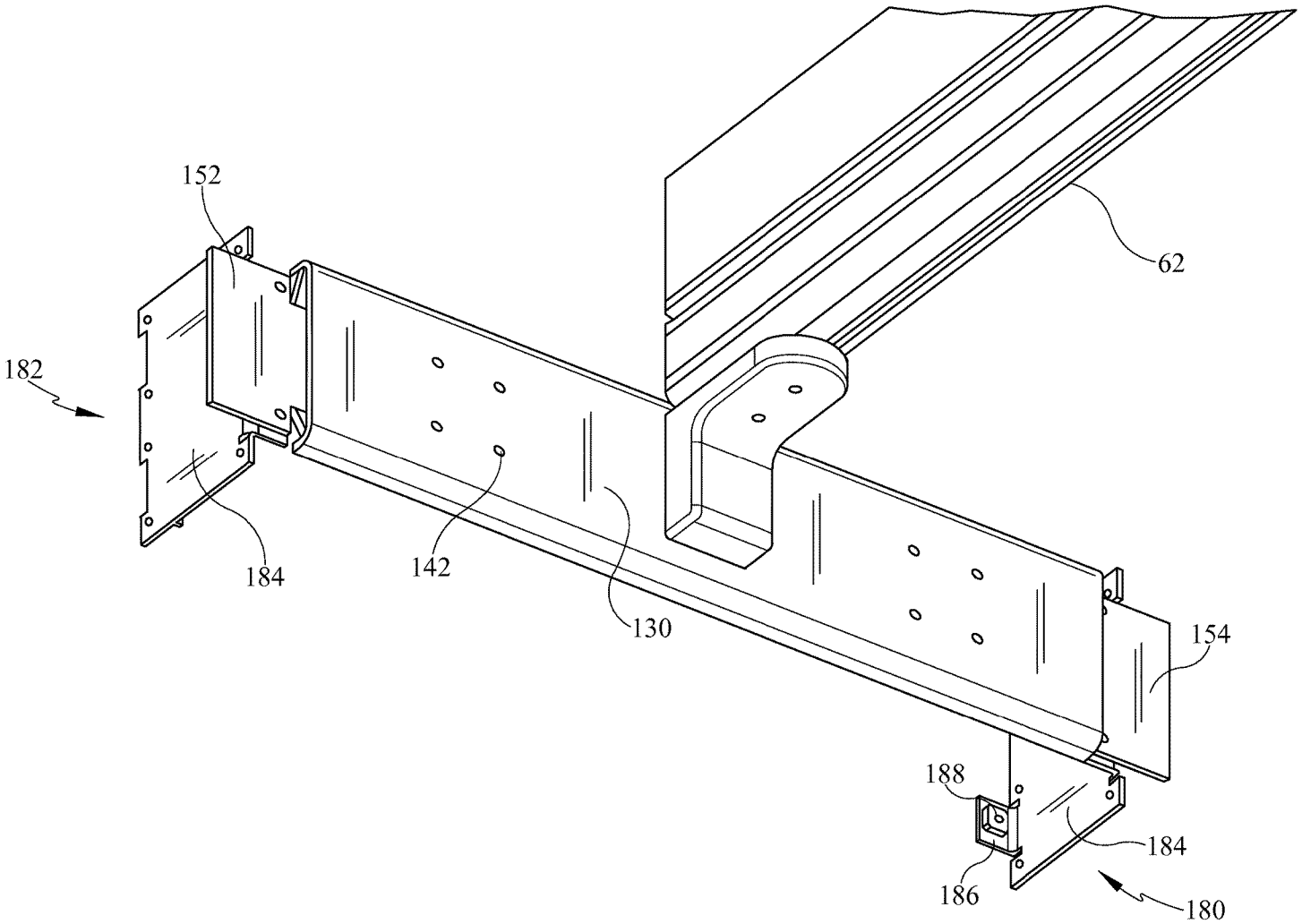

As seen best in FIGS. 7-8 screws or bolts, not shown, are used to connect tabs 186 of brackets 180, 182 to wings 152, 154 of beam back plate 132 so that first beam 126 extends laterally between and is connected to each of the left and right first stanchions 120, 122.

A second frame F2 is longitudinally spaced from first frame F1. The construction of the second frame is the same as that of the first frame. Accordingly, common reference numerals are used herein to refer to like components in frames F1 and F2, and modifiers "first" and "second" are used when necessary to distinguish between a component of frame F1 and a counterpart component of frame F2. In particular the second frame comprises left and right second stanchions 120, 122 and a second beam 126 extending between and connected to each of the left and right second stanchions.

At least one of the frames, and typically both of the frames, extends to facility floor 12 and is surface mounted to an existing architectural wall 16, 18 of the facility such that the wall bears less than all of any vertical load imposed on or otherwise associated with the lift motor support system. It is intended that the architectural walls will bear less than a majority of the vertical load. It is further intended that the architectural headwall 16 will bear less than a majority of the vertical load borne by first frame F1 and that the architectural footwall 14 will bear less than a majority of the vertical load borne by the second frame F2. As a result of the foregoing load bearing arrangement, facility floor 12 may bear up to all of the vertical load imposed on or otherwise associated with the lift motor support system. It is intended that the floor will bear at least a majority of the vertical load.

Additional frames, such as frame F5 of FIG. 4, are similar to frames F1, F2 but do not necessarily include beam 126. One or more of such additional frames can be affixed to the architectural walls. The additional frames in combination with frames F1 and F2 comprise a framework or skeleton for a headwall or a footwall.

Figure 9:
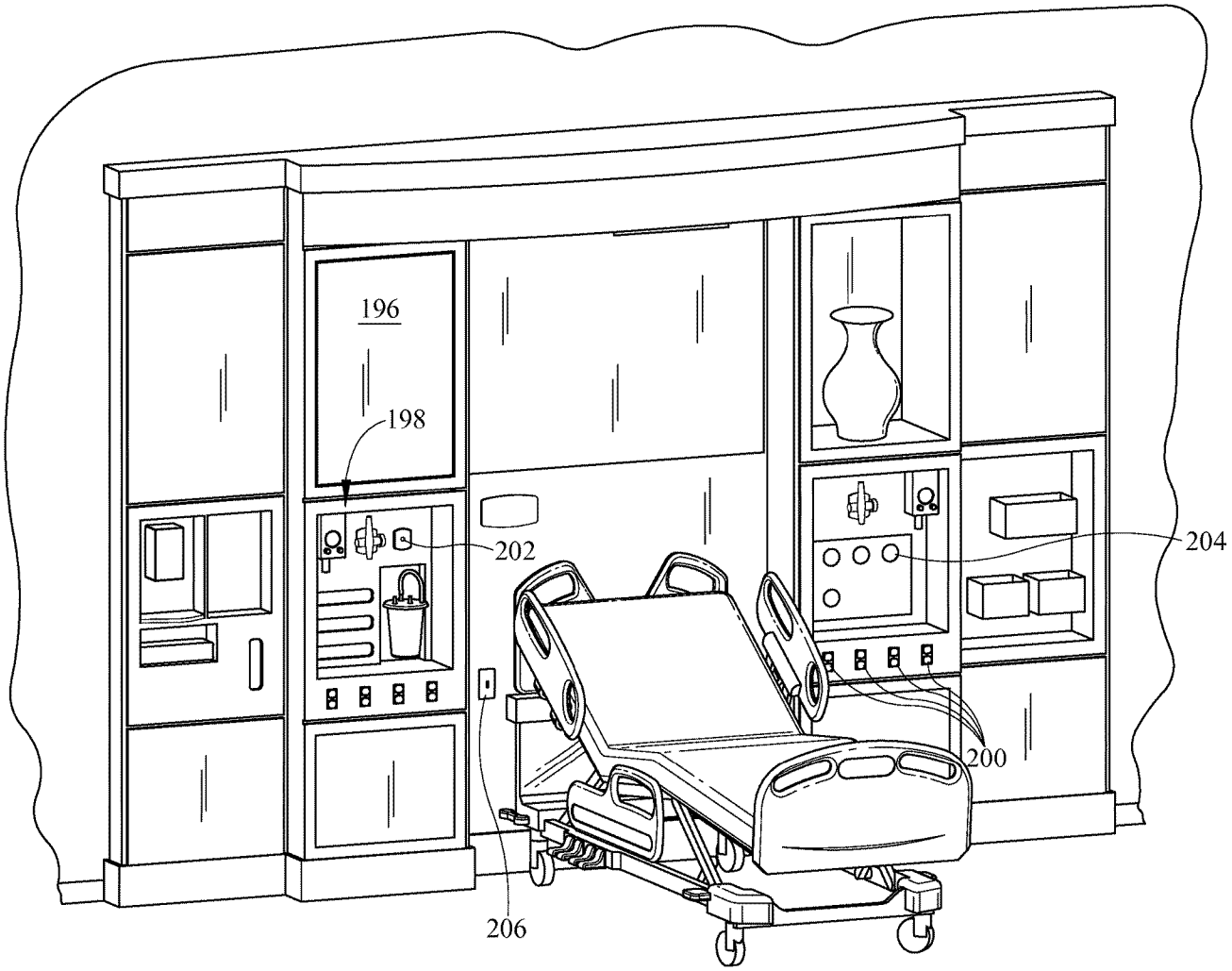
FIG. 9 is a view of a typical hospital room headwall.

As seen in FIG. 9, the headwall and footwall include one or more panels connectable to the frames. The panels may be exclusively decorative, such as panel 196. Alternatively some panels may be functional panels, such as panels 198, which include fixtures such as electrical outlets 200, medical gas outlets 202, suction ports 204, and lighting controls 206. Although a functional panel has functional aspects it may nevertheless be designed to be aesthetically pleasing.

It should also be appreciated that even if frames F1, F2 are used without additional frames F5, the frames F1, F2 can nevertheless be outfitted with decorative and/or functional panels.

Referring principally to FIGS. 5-8, the lift motor support system also includes a first connector 230 connected to first beam 126 of frame F1 at a selected one of the sets of holes 142 in the beam and a second connector 232 connected to second beam 126 of frame F2 at a corresponding set of holes 142 in the second beam. The system also includes a rail 62 which is not affixed to or supported from the ceiling but instead has a head end 236 connected to first connector 230 and a foot end 238 connected to second connector 232. As a result, vertical loads imposed on the rail are reacted through first and second frames F1, F2. As previously noted at least one of the frames, and typically both of the frames, extends to facility floor 12 such that the facility architectural walls bear less than all of any vertical load imposed on the lift motor support system. It is intended that the architectural walls will bear less than a majority of the vertical load. It is further intended that the architectural headwall 16 will bear less than a majority of the vertical load borne by first frame F1 and that the architectural footwall 18 will bear less than a majority of the vertical load borne by the second frame F2. Such loads include the weight of the rail itself, the weight of a motor unit 66 translatably engaged with the rail 62, and the weight of any patient being supported by the lift system.

FIG. 10 shows a power supply system for lift motor 74. The power supply system comprises an electrical power supply 250, for example an AC/DC converter 252 for converting alternating current from the facility electrical system to direct current for battery 74. The converter is nested interiorly between flanges 254 of one of stanchions 120 or 122. The power supply is hard wired to a facility electrical system by an input cable 258. An output coaxial cable 260 having a male connector 262 is provided to convey direct current to the motor. The male connector can be easily coupled to or uncoupled from a female connector 266 at one end of an input coaxial cable 268. The other end of input coaxial cable 268 includes leads 270, 272 connected to electrically conductive strips 274, 276, such as copper strips, that extend lengthwise along the length of lift motor rail 62. Power receiving rollers 280, 282 are mounted in the rail so that each roller is in contact with one of the electrically conductive strips. A battery cable 284 connects the power receiving rollers to positive and negative terminals of battery 72 so that the battery can be maintained at a suitable charge. As the lift motor unit is moved manually along the rail (i.e. perpendicular to the plane of FIG. 10) rollers 280, 282 remain in contact with strips 274, 276 so that battery charging can occur irrespective of the position of motor unit along the length of rail 62. Further description of the in-rail charging system is found in US Patent Application Publication 2012/0000876, the contents of which are incorporated herein by reference.

Figure 11:
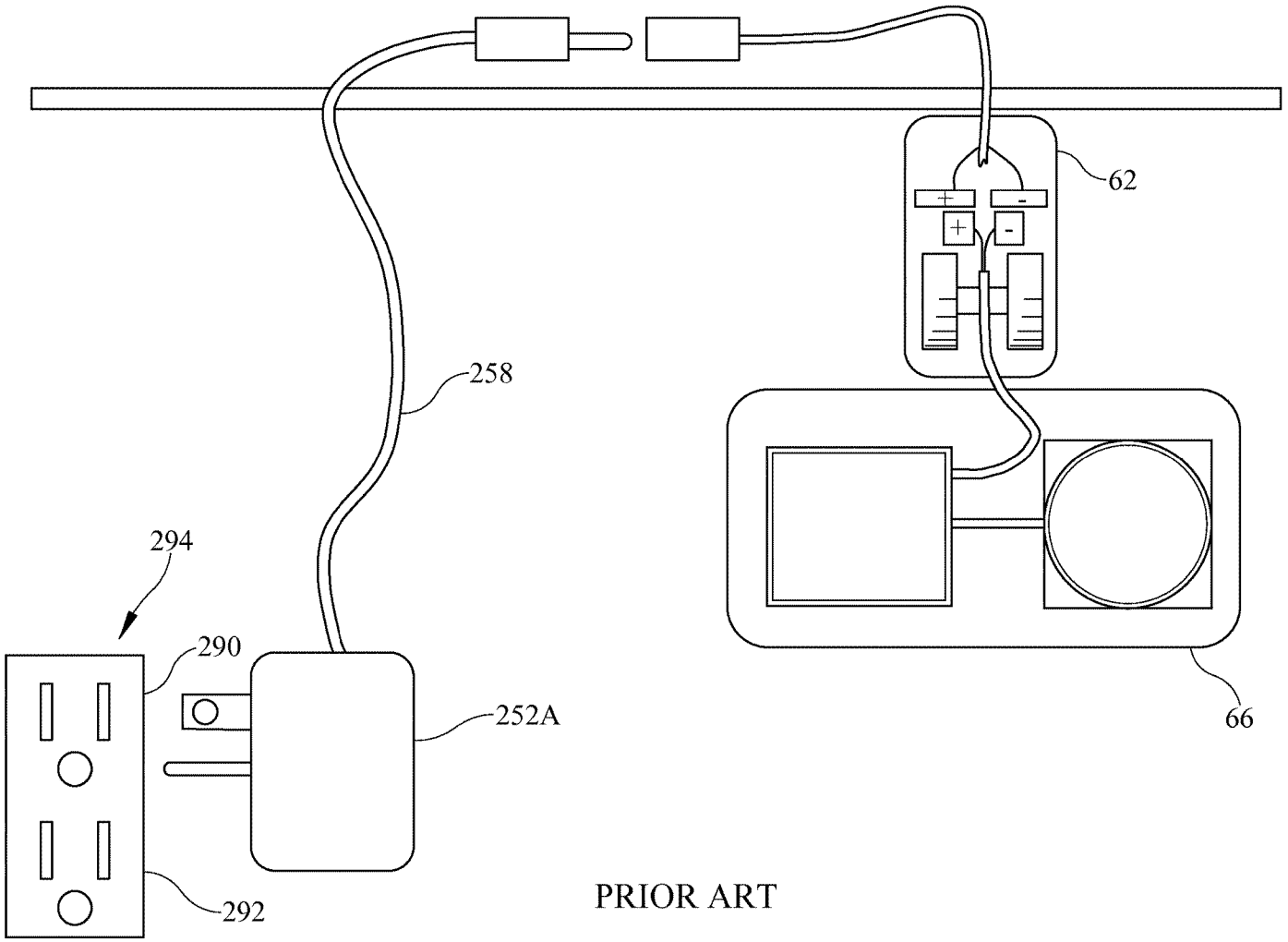
PRIOR ART FIG. 11
FIG. 11 is a schematic view of a prior art power supply system.

FIG. 11 shows a prior art power supply system in which input cable 258, rather than being hardwired to a facility electrical system, terminates with a plug-in converter 252A intended to be plugged into a socket such as the sockets 290, 292 of illustrated duplex outlet 294. Such an arrangement occupies a socket that may be needed for other purposes. Moreover, plug-in converters are typically bulky so that they not only occupy a socket but also block access to the other socket of the duplex outlet.

Figure 12:
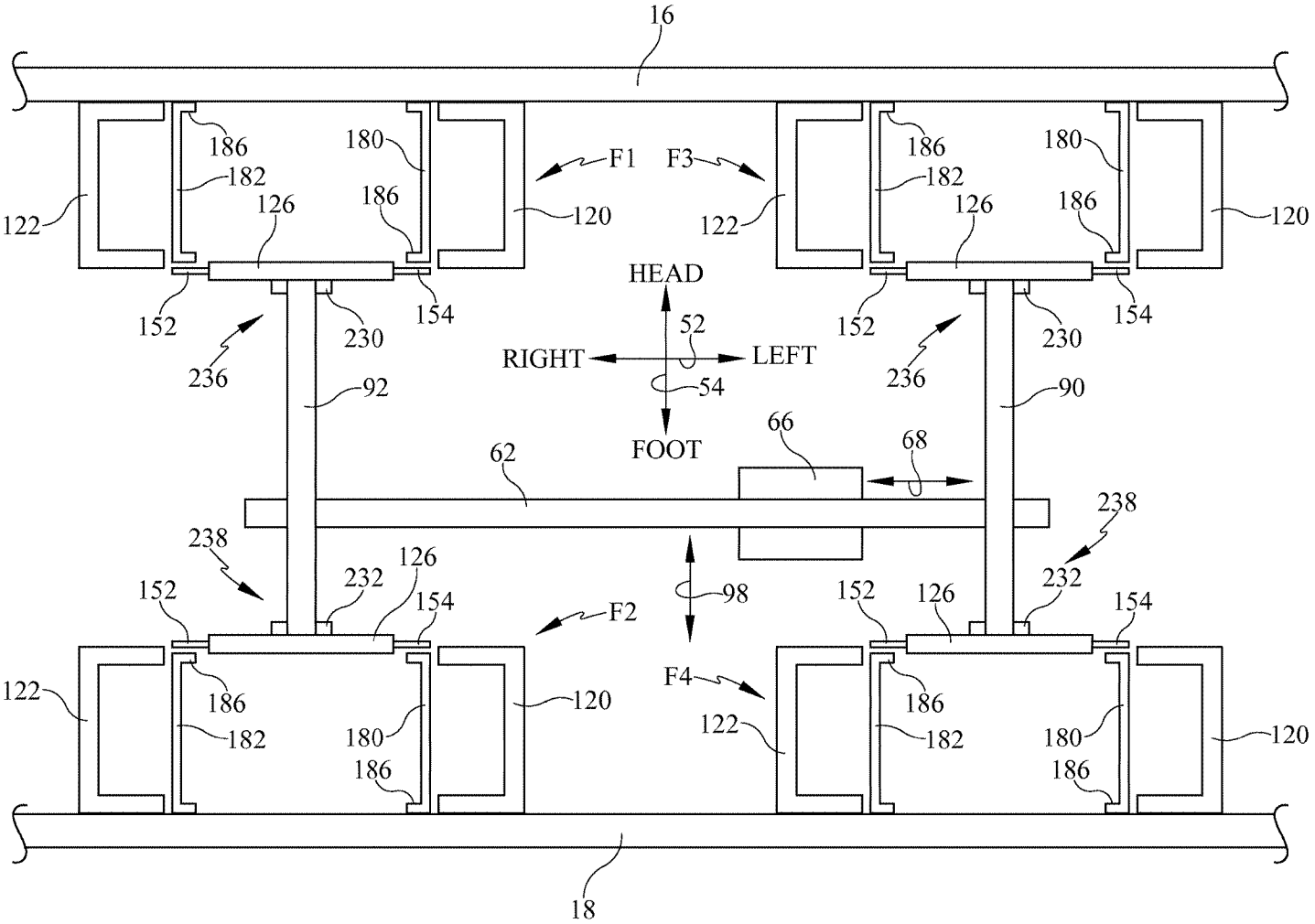
FIG. 12 is a plan view similar to that of FIG. 5 showing a hospotal room with a variant of the lift motor unit support system.

FIG. 12 shows a variant of the lift motor unit support system. The system of FIG. 12 includes a third frame F3 laterally spaced from the first frame F1 and a fourth frame F4 laterally spaced from second frame F2 and longitudinally spaced from third frame F3. The construction of the third and fourth frames is the same as that of the first and second frames. Accordingly, common reference numerals are used herein to refer to components of frames F3 and F4 that are analogs of components of frames F1 and F2, and modifiers "first" "second", "third" and "fourth" are used when necessary to distinguish between identically numbered components of frames F1, F2, F3 and F4. Frame F3 comprises left and right third stanchions 120, 122 and a third beam 126 extending laterally between and connected to each of the left and right third stanchions. Similarly, frame F4 comprises left and right fourth stanchions 120, 122 and a fourth beam 126 extending laterally between and connected to each of the left and right fourth stanchions.

The lift motor support system of FIG. 12 also includes a third connector 230 connected to third beam 126 and a fourth connector 232 connected to fourth beam 126. The lift motor support system also includes a first primary rail 90 having a head end 236 connected to third connector 230 and a foot end 238 connected to fourth connector 232. A second primary rail 92 is connected to first and second connectors 230, 232. Second primary rail 92 is analogous to rail 62 of FIGS. 4-8 except that unlike rail 62 of FIGS. 4-8, rail 92 is not engaged with a lift motor unit and therefore cannot be referred to as a lift motor rail. Instead, rail 92 is a companion to first primary rail 90. A traverse rail 62 is translatably engaged with the left and right primary rails and is longitudinally translatable along the rails, i.e. in the direction indicated by directional arrows 98. Lift motor unit 66 engages the traverse rail and is manually translatable therealong as indicated by arrow 68. Accordingly, traverse rail 62 may be referred to as a lift motor rail.

In all other respects the lift motor support system of FIG. 12 shares the features of the lift motor support system previously described. For example, one or more of the frames is surface mounted an existing architectural wall of the facility and extends to the floor such that the wall bears less than a majority of any vertical load associated with the support system or at least bears less than all of such load. One or more decorative or functional panels may be connectable to the frames. In one embodiment the left and right rails are not supported from the facility ceiling.

Although this disclosure refers to specific embodiments, it will be understood by those skilled in the art that various changes in form and detail may be made without departing from the subject matter set forth in the accompanying claims.

I claim:

1. A support system for a lift motor unit comprising:

a first frame comprising left and right first stanchions laterally spaced apart from each other and a first beam extending laterally between and connected to each of the left and right first stanchions;

a second frame longitudinally spaced from the first frame, the second frame comprising left and right second stanchions laterally spaced apart from each other and a second beam extending between and connected to each of the left and right second stanchions;

a first connector nonmovably connected to the first beam;

a second connector nonmovably connected to the second beam;

a rail having a head end connected to the first connector and a foot end connected to the second connector; and at least one electrical outlet, medical as outlet, or suction outlet supported by the first frame between the left and right first stanchions a third frame laterally spaced from the first frame, the third frame comprising left and right third stanchions laterally spaced apart from each other and a third beam extending laterally between and connected to each of the left and right third stanchions; a fourth frame laterally spaced from the second frame and longitudinally spaced from the third frame, the fourth frame comprising left and right fourth stanchions laterally spaced apart from each other and a fourth beam extending laterally between and connected to each of the left and right fourth stanchions; a third connector nonmovably connected to the third beam; a fourth connector nonmovably connected to the fourth beam; a first primary rail having a head end connected to the third connector and a foot end connected to the fourth connector; wherein the rail connected to the first and second connectors is a second primary rail and wherein a traverse rail is engaged with and longitudinally translatable along the first and second primary rails.

2. The support system of claim 1 wherein the rail is a lift motor rail and wherein the support system includes a lift motor unit translatably engaged with the lift motor rail.

3. The support system of claim 1 including a lift motor unit translatably engaged with the traverse rail.

4. The support system of claim 1 wherein one or more of the frames extends to a floor of a facility and is mounted to a wall of the facility such that the wall bears less than all of any vertical load associated with the support system.

5. The support system of claim 4 wherein the one or more frames is mounted so that the facility wall bears less than a majority of the vertical load.

6. The support system of claims 1 wherein one of more of the frames extends to a floor of the facility and is mounted to a wall of the facility such that the floor bears at least a majority of the vertical load imposed on or otherwise associated with the lift motor support system.

7. The support system of claim 6 wherein the one or more frames is mounted to the facility wall such that the floor bears substantially all of the vertical load.

8. The support system of claim 1 including one or more panels connectable to the frames.

9. The support system of claim 8 wherein the panels are exclusively decorative.

10. The support system of claim 8 wherein the panels are functional panels.

11. The support system of claim 1 wherein the rail is not supported from a ceiling.

12. The support system of claim 1 wherein the first and second primary rails are not supported from the ceiling.

13. The support system of claim 1 wherein one or more of the frames is surface mounted to an existing wall of the facility.

14. The support system of claim 1 including an electrical power supply affixed to one of the frames, the power supply being hard wired to a facility electrical system.

15. The support system of claim 14 including a lift motor unit translatably engaged with the rail, the lift motor unit housing a direct current motor powered by a battery and wherein the power supply is a converter for converting alternating current from the facility electrical system to direct current for the battery.

16. The support system of claim 1 wherein one or more of the frames extends to a floor of a facility and is mounted to a wall of the facility such that the wall bears less than all of any vertical load associated with the support system.

17. The support system of claim 16 wherein the one or more frames is mounted so that the facility wall bears less than a majority of the vertical load.

18. The support system of claim 1 wherein one of more of the frames extends to a floor of the facility and is mounted to a wall of the facility such that the floor bears at least a majority of the vertical load imposed on or otherwise associated with the lift motor support system.

19. The support system of claim 18 wherein the one or more fames is mounted to the facility wall such that the floor bears substantially all of the vertical load.

20. The support system of claim 1 including one or more panels connectable to the frames.

21. The support system of claim 20 wherein the panels are exclusively decorative.

22. The support system of claim 20 wherein the panels are functional panels.

23. The support system of claim 1 wherein the rail is not supported from a ceiling.

24. The support system of claim 1 wherein one or more of the frames is surface mounted to an existing wall of the facility.

25. The support system of claim 1 including an electrical power supply affixed to one of the frames, the power supply being hard wired to a facility electrical system.

26. The support system of claim 25 including a lift motor unit translatably engaged with the rail, the lift motor unit housing a direct current motor powered by a battery and wherein the power supply is a converter for converting alternating current from the facility electrical system to direct current for the battery.

* * * * *